US006141519A

United States Patent [19]

Sato

[11] Patent Number: 6,141,519

[45] Date of Patent: Oct. 31, 2000

[54] IMAGE-FORMING APPARATUS HAVING AT LEAST ONE OF ADDITIVES IN THE NON-MAGNETIC SINGLE-COMPONENT TONER EXHIBITING ELECTRICAL CONDUCTIVITY

[75] Inventor: Shougo Sato, Seto, Japan

[73] Assignee: Brother Kogyo Kabushiki Kaisha, Nagoya, Japan

[21] Appl. No.: 09/233,188

[22] Filed: Jan. 20, 1999

Related U.S. Application Data

[63] Continuation-in-part of application No. 08/759,225, Dec. 5, 1996, Pat. No. 5,867,755.

[30] Foreign Application Priority Data

Jan. 22, 1998 [JP] Japan ..... 10-010785

[51] Int. Cl.[7] ..... G03G 15/08; G03G 13/02

[52] U.S. Cl. ..... 399/252; 399/111; 430/110

[58] Field of Search ..... 399/111, 168, 399/170, 252, 125, 279, 286; 430/110

[56] References Cited

U.S. PATENT DOCUMENTS

| | | | |
|---|---|---|---|
| 4,563,076 | 1/1986 | Takahashi et al. | 399/125 |
| 4,640,880 | 2/1987 | Kawanishi et al. | 430/106.6 |
| 4,663,262 | 5/1987 | Oka et al. | 430/108 |
| 5,413,892 | 5/1995 | Matsuura et al. | 430/110 |
| 5,506,084 | 4/1996 | Ohta et al. | 430/106.6 |
| 5,608,501 | 3/1997 | Makino | 399/119 |
| 5,771,427 | 6/1998 | Makino | 399/120 |
| 5,842,091 | 11/1998 | Nakano | 399/111 X |
| 5,851,718 | 12/1998 | Ohwada et al. | 430/110 X |
| 5,867,755 | 2/1999 | Sato | 399/279 X |
| 5,885,743 | 3/1999 | Takayanagi et al. | 430/110 |

FOREIGN PATENT DOCUMENTS

| | | |
|---|---|---|
| 7-295285 | 11/1995 | Japan . |
| 8-152733 | 6/1996 | Japan . |

*Primary Examiner*—Sophia S. Chen
*Attorney, Agent, or Firm*—Oliff & Berridge, PLC

[57] ABSTRACT

An image-forming apparatus including, an electrostatic latent image carrier on the surface of which are formed electrostatic latent images; a scorotron type of charger that charges the surface of the electrostatic latent image carrier uniformly by corona discharge; an electrostatic latent image forming mechanism for forming the electrostatic latent images on the surface of the electrostatic latent image carrier after charging by the charger; and a development roller for conveying charged non-magnetic single-component developer to the surface of the electrostatic latent image carrier on which the electrostatic latent images have been formed by the electrostatic latent image forming mechanism and developing the electrostatic images. In the image-forming apparatus, images are formed by transferring to a recording medium the non-magnetic single-component developer that developed the electrostatic latent images, and at least one of additives in the non-magnetic single-component developer exhibits electrical conductivity.

6 Claims, 3 Drawing Sheets

IMAGE-FORMING APPARATUS HAVING AT LEAST ONE OF ADDITIVES IN THE NON-MAGNETIC SINGLE-COMPONENT TONER EXHIBITING ELECTRICAL CONDUCTIVITY

This application is a Continuation-in-Part of U.S. patent application Ser. No. 08/759,225, filed Dec. 5, 1996, now U.S. Pat. No. 5,867,755.

BACKGROUND OF THE INVENTION

1. Field of the Invention

This invention relates to an image-forming apparatus that transfers a developer to a recording medium to form an image, and more particularly to an image-forming apparatus that employs a scorotron type of charger.

2. Description of the Related Art

Image-forming apparatuses are known in the prior art which comprise an electrostatic latent image carrier such as a photosensitive drum on the surface of which are formed electrostatic latent images, a scorotron type of charger that charges the surface of the electrostatic latent image carrier uniformly by corona discharge, electrostatic latent image forming means for forming the electrostatic latent images on the surface of the electrostatic latent image carrier after charging by the charger, and development means for developing, with a developer such as toner, the electrostatic latent images formed by the electrostatic latent image forming means. With this type of image-forming apparatus, electrostatic latent images are formed by the electrostatic latent image forming means on the surface of the electrostatic latent image carrier that is charged uniformly by the charger, the electrostatic latent images are developed by developer charged by friction-charging by the development means, and then developer is transferred to a recording medium to form images.

The scorotron type of charger here described excels in uniform charging. The electrostatic latent image carrier is charged without contact, so that it exhibits less deterioration in toner adhesion, and excels in durability, as compared with a charger using contact charging. Also, with so-called electrophotographic image-forming apparatuses that form images by transferring a developer such as toner to a recording medium, maintenance can be simplified by using a cartridge constituted of i) toner that is consumed and ii) the constituting components such as the electrostatic latent image carrier and development means where the electrostatic latent image carrier exhibits deterioration faster than the other constituting components, so that the cartridge can readily be replaced as one unit. On the other hand, there is keen demand to reduce the number of replacement components as far as possible in the interest of environmental protection. The idea has thus been conceived of constitution the scorotron type of charger, which excels in durability, separately from the replacement components unified in the cartridge, so that it can be used repeatedly.

However, the scorotron type of chargers also deteriorate, for the reasons noted next, and from time to time must be replaced inevitably. For that reason they are in some cases incorporated into the cartridge as one of the replacement components. More specifically, in recent years, instead of the two-component developer systems containing toner and carrier, single-component developer systems containing no carrier have come into wide use in view of the ease of maintaining image-forming apparatuses and making them compact. With single-component developer systems, a substance corresponding to the carrier is contained in the toner, and, when the toner is moved using magnetic force, the toner is made to contain magnetic materials. However, the magnetic materials are opaque, so that, especially with color development, it is more suitable to use a non-magnetic developer. That being so, in recent years, it is becoming increasingly common to use a non-magnetic single-component developer in electrophotographic image-forming apparatuses.

With non-magnetic single-component developers, however, various additives such as silica are added to the toner to secure its fluidity. Among these additives are those which peel and drop away from the toner prior to transfer to the recording medium. Such additives sometimes adhere to the discharge wires on the scoroton type of chargers. When this happens, an insulating film is formed on the surface of the discharge wires, and hence the surface of the electrostatic latent image carrier can no longer be adequately charged. In some cases, for example, discharge irregularities are caused by the film, and the images are not properly formed in places corresponding to the film. Thereupon there is no alternative but to replace the scorotron type of charger, making it very difficult to use it separately from the other replacement components or to use it repeatedly, as described above. It is possible to prevent the adherence of additives to the discharge wires by forming air currents about the discharger, but providing the necessary mechanisms therefor places enormous restrictions on the constitution of the image-forming apparatuses. That being so, improving the durability of the chargers by providing such mechanisms is not very practical.

SUMMARY OF THE INVENTION

An object of the present invention is to provide an image-forming apparatus that employs a scorotron type of charger, wherein the durability of the charger is adequately improved.

The invention provides is an image-forming apparatus including:

an electrostatic latent image carrier on the surface of which are formed electrostatic latent images;

a scorotron type of charger that charges the surface of the electrostatic latent image carrier uniformly by corona discharge;

electrostatic latent image forming means for forming the electrostatic latent images on the surface of the electrostatic latent image carrier after charging by the charger; and development means for conveying charged non-magnetic single-component developer to the surface of the electrostatic latent image carrier on which the electrostatic latent images have been formed by the electrostatic latent image forming means and developing the electrostatic images, where images are formed by transferring to a recording medium the non-magnetic single-component developer that developed the electrostatic latent images, wherein at least one of additives in the non-magnetic single-component developer exhibits electrical conductivity With the present invention, constituted in this manner, in an image-forming apparatus wherein a scorotron type of charger is used, a non-magnetic single-component developer is constituted such that at least one additive contained therein exhibits electrical conductivity For this reason, even if this electrically conductive additive peel away from the non-magnetic single-component developer and adhere to the charger, no insulating film will be formed on the charger.

Accordingly, when the additive adheres thereto, the performance of the charger can be maintained, and the surface of the electrostatic latent image carrier can be uniformly and adequately charged. In the present invention, moreover, by making the additive electrically conductive, the durability of the charger is improved. Thus the image-forming apparatus is not subjected to any constitutional restriction whatever. Thus the invention can easily be applied to various image-forming apparatuses.

That being so, with the present invention, it is possible to improve the durability of the scorotron type of charger so that it is extremely good. Thus, by constituting the charger separately from the other replacement components and using it repeatedly, it is possible to significantly reduce the number of replacement components. By so doing, it is also possible to minimize the effects on the environment.

In the present invention, it is preferred that the non-magnetic single-component developer additive comprises in a mixing state a plurality of types of additives having different mean particle diameters, wherein the additive exhibiting electrical conductivity is not the additive among the plurality of types that has the smallest mean particle diameter.

The additives added to the non-magnetic single-component developer are of very diverse size. Small additives, while nicely improving the fluidity of the non-magnetic single-component developer, easily sink into the developer during periods of prolonged use. Large additives, on the other hand, although they impair fluidity if added excessively, are able nevertheless to suppress the sinking of the small additives when added. That being so, it is common to add a plurality of types of additives, having different mean particle diameters, to the non-magnetic single-component developer. In the present invention, the additive exhibiting electrical conductivity is not the additive among the plurality of types that has the smallest mean particle diameter.

The larger the mean particle diameter of the additive, the more readily will it peel away from the non-magnetic single-component developer during prolonged use, giving rise to a high probability of it adhering to the charger. In the present invention, the additive exhibiting electrical conductivity is such that it does not have the smallest mean particle diameter, so that the effect of making that additive be electrically conductive appears more conspicuously. Accordingly, in the present invention, in addition to the benefit as mentioned above, there can be obtained a benefit that the durability of the charger definitely and efficiently is improved. Thus the number of replacement components can be even further reduced, and the influence on the environment further diminished. If, moreover, the additive exhibiting electrical conductivity is made the additive among the plurality of types that has the largest mean particle diameter, the benefit noted above will appear even more conspicuously, and hence that will of course be that much more desirable.

In the present invention, it is further preferred that, in addition to the constitution as stated above, that the mean particle diameter of the additive exhibiting electrical conductivity is 30 nm or greater.

An additive having a mean particle diameter of 30 nm or greater will, in the main, impair fluidity if added excessively, but is a type of additive that can suppress the sinking of small additives. In the present invention, the additive exhibiting electrical conductivity is made to have a mean particle diameter of 30 nm or greater, so that the benefit of making that additive be electrically conductive appears even more conspicuously. That being so, in the present invention, in addition to the benefits of the inventions as mentioned above, there can be obtained the benefit that the durability of the charger is further improved. Accordingly, the number of replacement components can be further reduced, and the influence on the environment further diminished.

In the present invention, in addition to the constitution as stated above, it is still further preferred that the additive exhibiting electrical conductivity is at least one type selected from silica, titanium oxide, and alumina, that has been subjected to electrical conductivity surface treatment.

Silica, titanium oxide, and alumina are known as ideal additives for suitably adjusting the charging properties and fluidity of the non-magnetic single-component developer, and forming good images. In the present invention, as the additive exhibiting electrical conductivity, there is used at least one type selected from silica, titanium oxide, and alumina, which has been subjected to electrical conductivity surface treatment, so that extremely good image formation can be achieved. Accordingly, with the present invention, in addition to the benefits of the present invention as mentioned above, there can further be obtained the benefit that better images can be formed.

In the present invention, in addition to the constitution as mentioned above, it is still further preferred that at least the electrostatic latent image carrier, the development means, and the non-magnetic single-component developer are accommodated in a process cartridge that can be removably loaded in the main image-forming apparatus unit, and the charger is fixed in that main image-forming apparatus unit.

The electrostatic latent image carrier and the non-magnetic single-component developer must be replaced, as is common knowledge, but in the present invention, having the constitution as mentioned above, the charger does not need to be replaced, as stated earlier. In the present invention, the electrostatic latent image carrier, development means, and non-magnetic single-component developer that need replacement can be removably loaded in the main image-forming apparatus unit, and integrated with the process cartridge, while the charger requiring no replacement is fixed in the image-forming apparatus. For this reason, it is extremely easy to implement the present invention such that, while the electrostatic latent image carrier and non-magnetic single-component developer are replaceable components, the charger is used repeatedly without replacement.

Accordingly, with the present invention, in addition to the benefits of the present invention as mentioned above, there can be obtained the benefit that both of a reduction in replaceable components and a diminishment of environmental influence can be readily realized.

In the present invention, in addition to the constitution as mentioned above, the non-magnetic single-component developer is friction-charged in conjunction with the development means, while supply means for supplying the non-magnetic single-component developer are additionally provided in the development means.

In the present invention, it is possible to friction-charge the non-magnetic single-component developer while supplying that non-magnetic single-component developer to the development means, by the supply means. Thus, when the non-magnetic single-component developer is charged by friction, the constitution of the image-forming apparatus can be made extremely simple. Accordingly, with the present invention, in addition to the benefits of the present inventions as mentioned above, there can be obtained the additional benefit that the constitution of the apparatus can be made simpler.

This and other objects, features and advantages of the present invention are described in or will become apparent from the following description of the preferred embodiments.

DESCRIPTION OF THE PREFERRED EMBODIMENT

Figure 1:
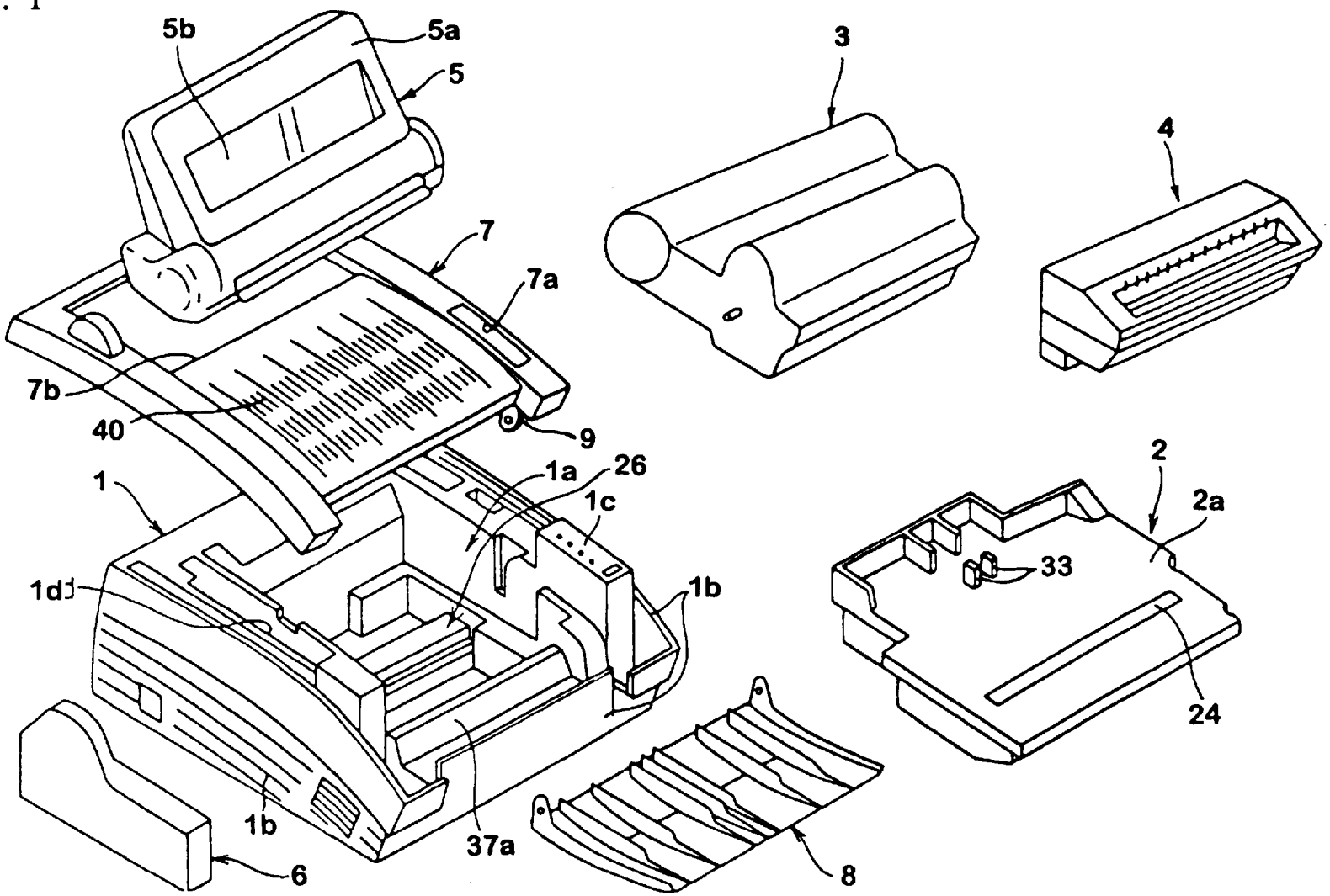
FIG. 1 is a perspective view of the main constitutional components of a laser printer in one embodiment.
Figure 2:
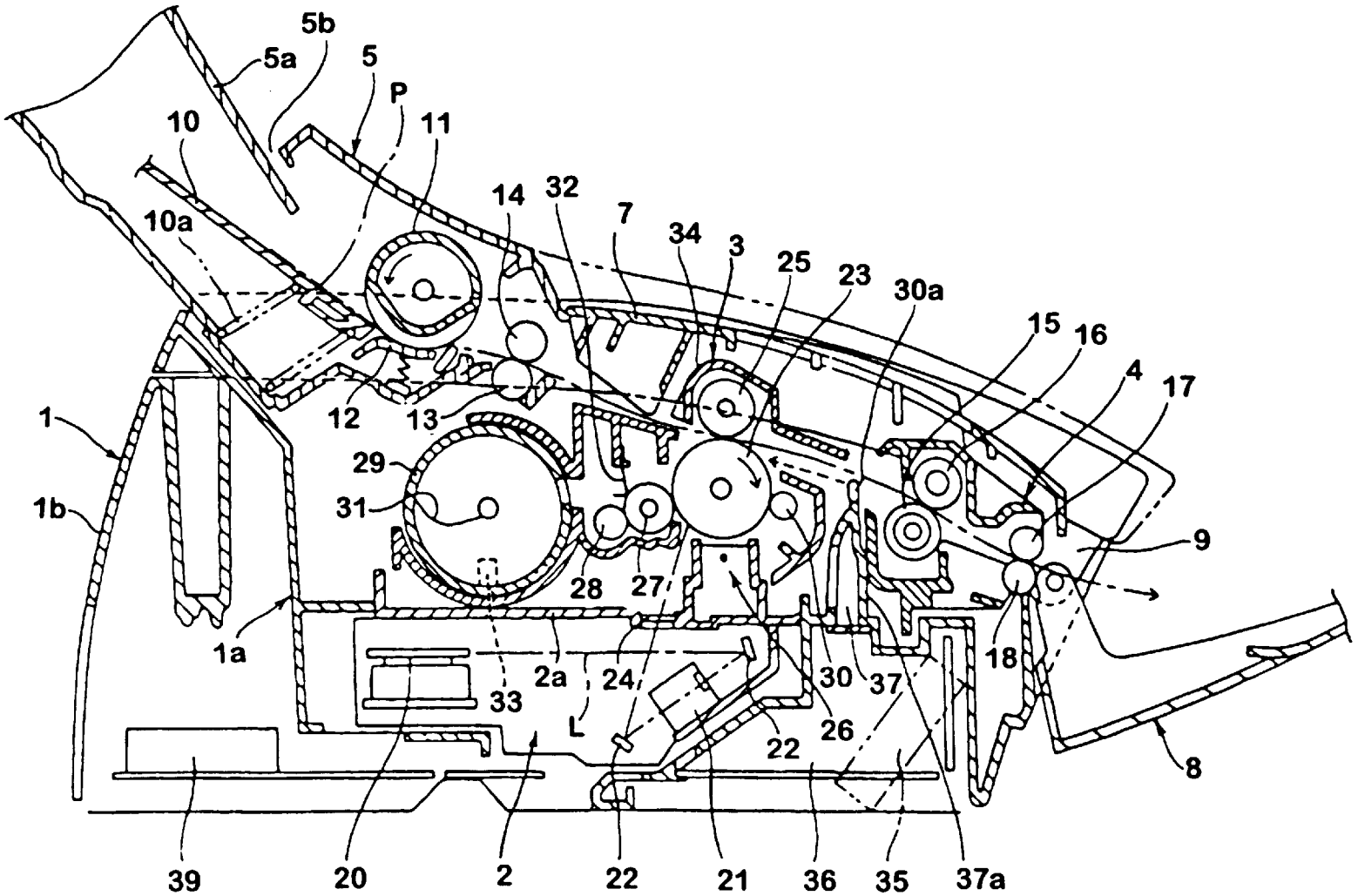
FIG. 2 is a simplified lateral cross-sectional view of the laser printer in FIG. 1.

Embodiments of the present invention are now described in conjunction with the drawings. FIG. 1 is a perspective view of the main constitutional components of a laser printer that is an image-forming apparatus in which the present invention is employed. FIG. 2 is a simplified lateral cross-sectional view of the laser printer.

In this laser printer, a main case 1 made of a synthetic resin, as shown in FIG. 1, comprises a main frame 1*a*, and a main cover 1*b* that covers the four outer circumferential (i.e. front, back, left, and right sides) surfaces of the main frame 1*a*. The main frame 1*a* and main cover 1*b* are formed integrally by injection molding, etc.

In the main frame 1*a*, from the upper surface, are loaded a scanner unit 2 as the exposure unit, a process cartridge 3 as the image formation component, a fixing unit 4 as a fixing component, and a paper feeder unit 5.

A drive system unit 6 that includes a drive motor and gear train is loaded by inserting it from the bottom of the main case 1 into a housing cavity 1*d* between the left inner surface (in FIG. 1) of the main cover 1*b* and the left side of the main frame 1*a* as it comes nearer thereto, and there fixed in place. Also, in a top cover 7 that is a main unit cover, made of a synthetic resin, for covering the upper surfaces of the main frame 1*a* and main cover 1*b*, are formed a hole 7*a* through which is passed an operating panel component 1*c* that projects upwards on the right side of the main frame 1*a*, and a hole 7*b* through which is passed the base part of the paper feeder unit 5. The base part of a paper discharge tray 8 is attached to brackets 9 (only one of which is shown in FIG. 1) that protrude on the left and right sides at the front edge of the top cover 7, so that it can swing up and down. When not in use, the paper discharge tray 8 can be folded so that it covers the upper surface side of the top cover 7.

Recording paper P, the recording medium, is set in a stacked condition inside a feeder case 5*a* in the paper feeder unit 5. As shown in FIG. 2, the leading end of the recording paper P is pressured toward a paper feed roller 11 by a support plate 10 activated by a spring 10*a* inside the feeder case 5*a*. Thus the recording paper P can be separated and sent to a pair of resist rollers 13 and 14 (upper and lower), one page at a time, by a separator pad 12 and the paper feed roller 11 that is turned by power transmitted from the drive system unit 6.

The process cartridge 3 forms images with toner T (cf. FIG. 3) on the surface of the separated recording paper P that is fed in by the resist rollers 13 and 14. The fixing unit 4 heats the recording paper P, on which toner T images have been formed, by sandwiching the recording paper P between a heating roller 15 and a pressure roller 16, thereby fixing the toner images on the recording paper P. A paper discharge section, comprising a paper discharge roller 17 and pinch roller 18, positioned on the downstream side inside the case of the fixing unit 4, discharges the recording paper P on which toner images have been fixed into the paper discharge tray 8. The recording medium conveyance route extends from the paper feed roller 11 to the paper discharge section. A manual insertion slot 5*b* is provided in the paper feeder unit 5, opening diagonally upward, so that recording-paper other than the recording paper P in the feeder case 5*a* can be inserted into the recording medium conveyance route and printed.

Positioned below the process cartridge 3 placed roughly in the center, as seen from above, of the main frame 1*a* that is shaped like a box open at the top in the main case 1, an upper support plate 2*a* on the scanner unit 2 is fixed by machine screws or the like to a stay formed integrally with the upper surface side of the bottom plate component of the main frame 1*a*. In the scanner unit 2 as the exposure unit, on the bottom surface side of the upper support plate 2*a* made of a synthetic resin, a laser generator unit (not shown), polygon mirror 20, lens 21, and reflecting mirror 22, etc., are positioned. In the upper support plate 2*a* is provided a glass plate 24 that covers a laterally long scanner hole formed so that it extends along the axis of a photosensitive drum 23 that is the electrostatic latent image carrier. A laser beam L emitted from the laser generator unit is directed onto the outer circumferential surface of the photosensitive drum 23 in the process cartridge 3 via the polygon mirror 20, reflecting mirror 22, lens 21, and glass plate 24, etc.

Figure 3:
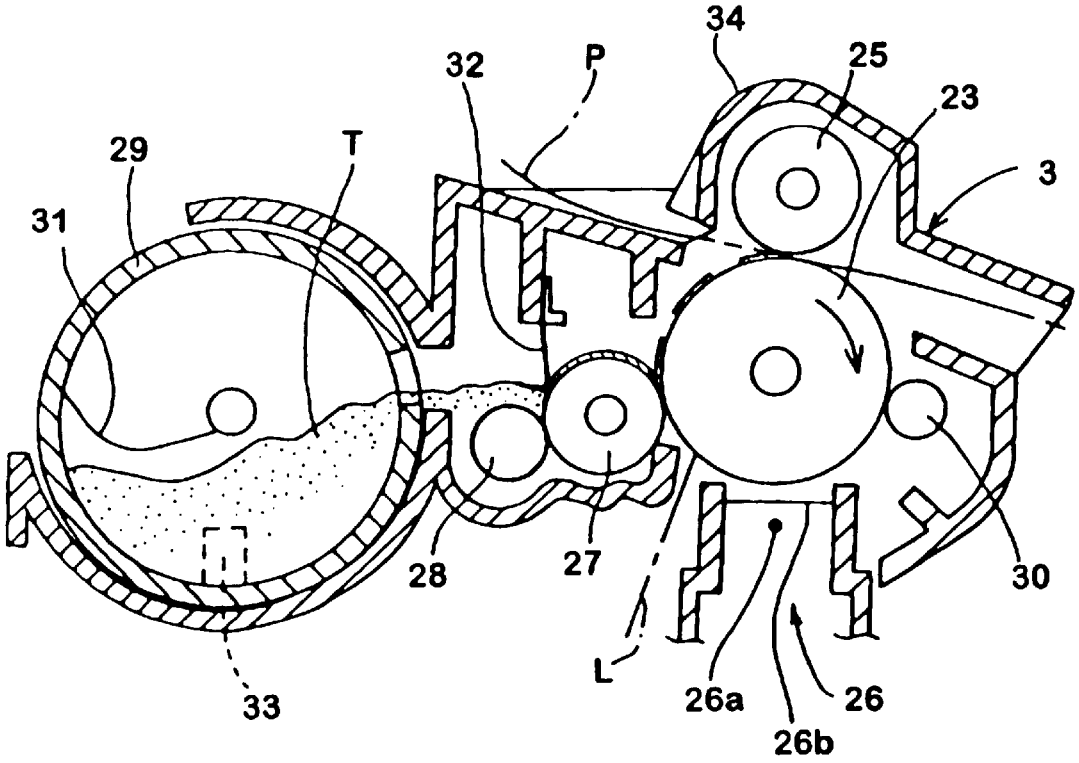
FIG. 3 is an enlarged view of the constitution of the process cartridge.

As shown in FIG. 2 and FIG. 3, the process cartridge 3 comprises: a development apparatus containing the photosensitive drum 23 and a transfer roller 25 in contact with the upper surface thereof, a development roller 27 that, as development means, is placed upstream side from the photosensitive drum 23 in the direction of paper feed, and a supply roller 28 that, as supply means, is placed further upstream side; a developer supply unit placed yet further upstream side, that is, a toner cartridge 29 that is removably loadable in the process cartridge 3, and a cleaning roller 30, etc., positioned downstream from the photosensitive drum 23. The process cartridge 3 is formed a cartridge by assembling these component elements into case 34 made of a synthetic resin. This process cartridge 3, formed thusly into a cartridge, is loaded in he main frame 1*a* such that it is removable. The photosensitive drum 23, development roller 27, and supply roller 28 all turn clockwise in FIG. 2.

Between the process cartridge 3 and fixing unit 4 is provided a static eliminating lamp 30*a* for static-eliminating the photosensitive drum 23. Also, a charger 26 is provided below the photosensitive drum 23. The charger 26 is a commonly known positive-charging scorotron type of charger that comprises a discharge wire 26*a* made of tungsten, etc., and a grid electrode 26*b*, and is provided integrally on the upper surface of the upper support plate 2*a* of the scanner unit 2.

On the outer circumferential surface of the photosensitive drum 23, in a photosensitive layer charged by the charger 26, an electrostatic latent image is formed by the scanning of the laser beam L, modulated according to image information by the scanner unit 2. In other words, the scanner unit 2 corresponds to the electrostatic latent image forming means. As is shown in enlarged view in FIG. 3, the toner T that is stored inside the toner cartridge 29 as the developer is stirred by a stirrer 31 and released, after which it is carried via the supply roller 28 to the outer circumferential surface of the development roller 27, so that the thickness of the layer at the outer circumferential surface of the development roller 27 is restricted by a layer thickness restricting blade 32. The electrostatic latent image on the photosensitive drum 23 is made manifest (developed) by the adhesion of toner T from the development roller 27. The composition of this toner T and the development mechanism etc., described above are described in greater detail below.

The image (toner image) formed on the photosensitive drum 23 by the toner T is transferred to the recording paper P that passes between the photosensitive drum 23 and the transfer roller 25 to which is applied a transfer bias having the opposite electric potential from the potential on the photosensitive drum 23, forming a toner image. The toner T remaining on the photosensitive drum 23 is temporarily collected by the cleaning roller 30, after which it is returned to the photosensitive drum 23 according to prescribed timing, and collected into the process cartridge 3 by the development roller 27.

On the upper support plate 2*a* (cf. FIG. 2) of the scanner unit 2 is provided a toner sensor 33 that projects upward. This toner sensor 33, which is made up of a light emitter and a photodetector, faces the inside of the lower cavity of the toner cartridge 29 in the process cartridge 3 so that it can detect the presence or absence of toner T inside the toner cartridge 29.

Returning to FIG. 2, on the lower surface side of the connecting part between the front of the main frame 1*a* and the front of the main cover 1*b*, a housing unit 36 is provided for housing a cooling fan 35, formed in conjunction with a ventilation duct 37 that extends left and right, perpendicular to the direction of passage of the recording paper P. The upper panel portion 37*a* of the ventilation duct 37 is formed such that its cross-sectional shape is that of an inverted V. This upper panel portion 37*a* is positioned between the process cartridge 3 and the fixing unit 4, so that the heat produced by the heating roller 15 in the fixing unit 4 is blocked from being transmitted directly to the process cartridge 3 side.

The cooling air flow produced by the cooling fan 35 passes through the interior of the ventilation duct 37, is conveyed along one lower side surface of the main frame 1*a*, and cools the power supply 39 and the drive motor in the drive system unit 6. At the same time, the cooling air flow passes inside the upper panel portion 37*a*, and is blown out from slits that open at multiple places on the process cartridge 3 side. This cooling air flow rises, passing between the process cartridge 3 and the fixing unit 4, and exits to the outside of the apparatus through multiple exhaust holes 40 (cf. FIG. 1) formed in the top cover 7.

The toner image development mechanism is next described. First, the toner T stored in the toner cartridge 29 contains toner mother particles having a mean particle diameter of 9 $\mu$m formed by adding a known colorant such as carbon black, and charge controlling agents such as nigrosine, triphenyl methane, and quaternary ammonium salts, etc., to a styrene acrylic resin formed into beads by suspension polymerization. This toner T is known as a positive-chargeable non-magnetic single-component developer. This toner T, furthermore, is constituted with silica and titanium oxide added as additives to the surface of the toner mother particles. The additives above are, respectively, also subjected to a known hydrophobic treatment using a silane coupling agent, etc., and the titanium oxide therein, in particular, is further subjected to a known electrical conductivity surface treatment using something like stannic oxide doped with antimony. The titanium oxide, which is the large-particle-diameter additive, has a mean particle diameter of 40 nm, and is added to 1.0 wt % of the toner mother particles. The silica, which is the small-particle-diameter additive, has a mean particle diameter of 10 nm, and the amount thereof added is 0.6 wt % total.

The supply roller 28 is a so-called foam roller constituted from a urethane foam having continuous bubbles. The number of bubble cells therein is to be less than 30 per 1 inch (2.54 cm). The development roller 27 is constituted as a cylinder the base material of which is silicone rubber, but containing also fine particles of carbon, etc.

Thus, when the supply roller 28 and the development roller 27 turn in the direction noted above while in mutual contact, and toner T is rubbed between them, so that the toner T is readily friction-charged to a positive charge. Also, the development roller 27 is cylindrical with a smooth surface, and is constituted by a substance (silicone rubber) having a comparatively high dielectric constant, so that the positively charged toner T adheres to the surface of the development roller 27 with a strong image force. Accordingly, the toner T can easily be charged positively by the supply roller 28 and the development roller 27 and conveyed to the surface of the photosensitive drum 23. The development roller 27 need not necessarily be made so that its entire base material is silicone rubber; the same effect can be gained by coating the surface of the base material with silicone rubber.

The photosensitive drum 23 is constituted from a positive-chargeable photosensitive material. It may be constituted, for example, by taking a grounded aluminum cylindrical sleeve and forming about the outer circumference thereof a photoconductive layer wherein a photoconductive resin is dispersed in a polycarbonate. For this reason, in the region where the development roller 27 and the photosensitive drum 23 are in mutual opposition, the positively charged toner T can be developed in a reverse developing mode, relative to the electrostatic latent image of plus polarity (positively charged) formed on the photosensitive drum 23. By taking the toner image developed in this way and transferring it to the recording paper P at the opposing position with the transfer roller 25, as described in the foregoing, the desired image can be formed on the recording paper P.

In the laser printer constituted as described in the foregoing, a scorotron type of charger 26 is employed, so that it is possible to charge the photosensitive drum 23 uniformly. Not only so, but the charger 26 is a so-called positive-charging charger that charges the photosensitive drum 23 positively, so there is little generation of ozone. The toner T has such additives as silica and titanium oxide added to it, in a mixture, moreover, of large and small mean particle diameters, thereby making it possible to appropriately adjust the charging properties and fluidity of the toner T. For these reasons, extremely good images can be formed.

With the scorotron type of charger 26, moreover, the photosensitive drum 23 is charged without contact, so that there is little deterioration due to the adherence of toner T as compared to a charger using contact charging, and excels in durability. In addition, the titanium oxide that has the largest mean particle diameter among the additives in the toner T has electrical conductivity imparted thereto by an electrical conductivity surface treatment, so that, even should this titanium oxide peel away from the toner T and adhere to the discharge wire 26*a*, no insulating film is formed on the surface of that discharge wire 26*a*. For that reason, the performance ability of the charger 26 is maintained in good order irrespective of the presence or absence of adhering additives. That being so, the charger 26 exhibits extremely good durability and need not be replaced.

Thereupon, with this laser printer, the charger 26 is fixed securely to the main printer body via the scanner unit 2, and the toner T charging and conveyance system extending from the toner cartridge 29 to the cleaning roller 30, together with the toner T contained therein, are removably loaded in the main printer body integrally with the process cartridge 3. For this reason, it is both easy to replace the toner T and the photosensitive drum 23, etc., together with the process cartridge 3, and, independently of such replacement, the charger 26 can be used repeatedly. Accordingly, in this laser printer, the number of replacement components can be reduced and the influence on the environment diminished extremely well and very easily.

Figure 4:
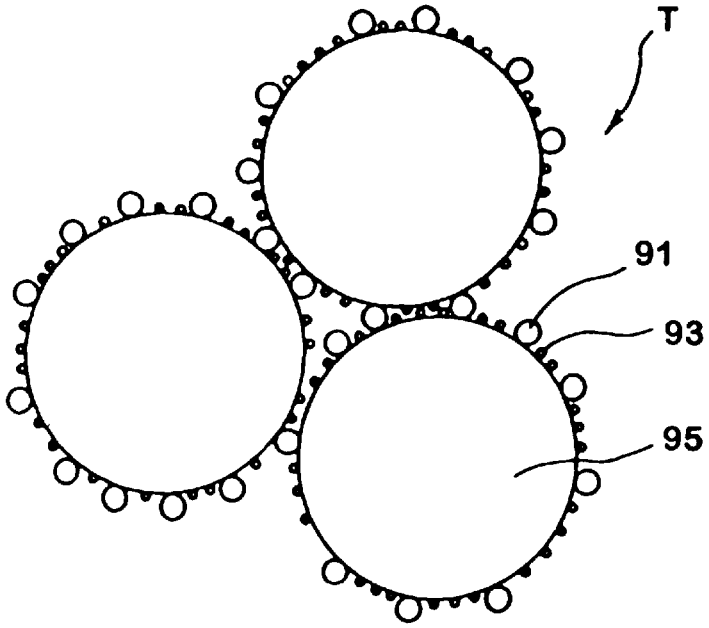
FIG. 4 is an explanatory diagram of the effect of adding a mixture of large and small additives.

With this laser printer, furthermore, electrical conductivity is not imparted to any additive other than titanium oxide, but this has almost no effect at all on the durability of the charger 26. More specifically, the additives having a small mean particle diameter of 30 nm or less are effective in improving the fluidity of the toner T, but readily sink into the toner mother particles when used for prolonged periods of time. For that reason, one may safely assume that there is almost no occurrence of a phenomena whereby the additives such as silica peel away and adhere to the discharge wire 26*a*. The additives having a mean particle diameter of 30 nm or greater (or preferably 40 nm or greater), on the other hand, as seen in the additive 91 exemplified in FIG. 4, can suppress the sinking of the smaller additive 93 into the toner mother particles 95. By adding a mixture of such large and small additives, the fluidity of the toner T is secured, but the latter, that is, the large additives, readily peel away from the toner mother particles, so that there is a high possibility that they will adhere to the discharge wire 26*a*. Therefore, if only the titanium oxide constituting the large additive is subjected to an electrical conductivity surface treatment, the durability of the charger 26 will be sufficiently guaranteed.

In the embodiment described in the foregoing, moreover, the mean particle diameter of the toner mother particles was made 9 $\mu$m, but this value may be anywhere in a range of from 6 $\mu$m to 10 $\mu$m. The mean particle diameter of the large-particle-diameter additives was made 40 nm and the amount thereof added was made 1.0 wt % of the toner mother particles, but these values need only be 30 nm or greater and 0.5 wt % or greater, respectively. The mean particle diameter of the small-particle-diameter additives was made 10 $\mu$m and the additive amount thereof was made 0.6 wt % of the toner mother particles, but these values need only be 30 nm or smaller and 0.5 wt % or greater, respectively.

With this laser printer, furthermore, the durability of the charger 26 is improved by making an additive electrically conductive, so the printer constituted is not subject to any restrictions whatever. Not only so, but the toner T is friction-charged by the development roller 27 and supply roller 28, so that the constitution for charging can also be simplified. That being so, the constitution of this laser printer can be simplified, the cost of manufacturing it can be reduced, and applications can easily be made in conventional mechanisms. When the toner T is friction-charged, the additives readily peel away, but in this laser printer the large additive (titanium oxide) is made electrically conductive, so that, even if this additive peels away, no problems whatever result therefrom, as already noted.

The present invention is in no way limited to or by the embodiment described in the foregoing, and can be implemented in various embodiments within such scope that the essence thereof is not compromised. In addition to the substances noted above for the additives, for example, various additives such as alumina can be used, and it is permissible to add three or more kinds of additive, or to make some other additive besides titanium oxide electrically conductive, or even to make all of the additives electrically conductive. The present invention may also be similarly applied in image-forming apparatuses such as copy machines wherein an electrostatic latent image is formed by a laser beam L reflected from the original, as well as in image-forming apparatuses wherein the toner T is charged by the layer thickness restricting blade 32.

The entire disclosure of the specification, claims, drawings and summary of Japanese Patent Application No-10-10785 filed on Jan. 22, 1998 is hereby incorporated by reference in its entirety.

What is claimed is:

1. An image-forming apparatus, comprising:

an electrostatic latent image carrier which is positively chargeable and on the surface of which are formed electrostatic latent images;

a scorotron type of charger that positively charges the surface of the electrostatic latent image carrier uniformly by corona discharge;

electrostatic latent image forming means for forming the electrostatic latent images on the surface of the electrostatic latent image carrier after charging by the charger; and development means for conveying a non-magnetic single-component developer positively charged to the surface of the electrostatic latent image carrier on which the electrostatic latent images have been formed by the electrostatic latent image forming means and developing the electrostatic images, where images are formed by transferring to a recording medium the non-magnetic single-component developer that developed the electrostatic latent images, wherein at least one of additives in the non-magnetic single-component developer exhibits electrical conductivity.

2. The image-forming apparatus according to claim 1, wherein the additives in the non-magnetic single-component developer comprise a plurality of types of additives having different mean particle diameters, wherein the additive exhibiting electrical conductivity is not that additive among the plurality of types thereof that has the smallest mean particle diameter.

3. The image-forming apparatus according to claim 1, wherein the additive exhibiting electrical conductivity has a mean particle diameter of 30 nm or greater.

4. The image-forming apparatus according to claim 1, wherein the additive exhibiting electrical conductivity is at least one type selected from silica, titanium oxide, and alumina, that has been subjected to electrical conductivity surface treatment.

5. The image-forming apparatus according to claim 1, wherein at least the electrostatic latent image carrier, the development means, and the non-magnetic single-component developer are accommodated in a process cartridge that can be removably loaded in a main image-forming apparatus unit, and the charger is fixed in the main image-forming apparatus unit.

6. The image-forming apparatus according to claim 1, wherein the non-magnetic single-component developer is friction-charged in conjunction with the development means, while supply means for supplying the non-magnetic single-component developer is additionally provided in the development means.

* * * * *